US009605844B2

(12) United States Patent
Pickard

(10) Patent No.: US 9,605,844 B2
(45) Date of Patent: Mar. 28, 2017

(54) LIGHTING DEVICE WITH HEAT DISSIPATION ELEMENTS

(75) Inventor: Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/551,921

(22) Filed: Sep. 1, 2009

(65) Prior Publication Data

US 2011/0050070 A1 Mar. 3, 2011

(51) Int. Cl.

| | |
|---|---|
| ***F21V 29/77*** | (2015.01) |
| ***F21V 29/00*** | (2015.01) |
| ***F21V 29/75*** | (2015.01) |
| ***F21V 29/87*** | (2015.01) |
| ***F21V 29/89*** | (2015.01) |
| ***F21V 29/51*** | (2015.01) |
| *F21V 29/505* | (2015.01) |
| *F21V 29/507* | (2015.01) |
| *F21Y 101/00* | (2016.01) |
| *F21Y 105/10* | (2016.01) |
| *F21Y 115/10* | (2016.01) |

(52) U.S. Cl.

CPC ..... *F21V 29/773* (2015.01); *F21V 29/004* (2013.01); *F21V 29/006* (2013.01); *F21V 29/51* (2015.01); *F21V 29/75* (2015.01); *F21V 29/87* (2015.01); *F21V 29/89* (2015.01); *F21V 29/505* (2015.01); *F21V 29/507* (2015.01); *F21Y 2101/00* (2013.01); *F21Y 2105/10* (2016.08); *F21Y 2115/10* (2016.08)

(58) Field of Classification Search

CPC ..... F21V 29/2262; F21V 29/2212; F21V 29/2206; F21V 29/75; F21V 29/77; H01L 33/64

USPC ..... 313/46

See application file for complete search history.

(56) References Cited

U.S. PATENT DOCUMENTS

| | | | | |
|---|---|---|---|---|
| 4,918,487 | A | 4/1990 | Coulter, Jr. | |
| 5,631,190 | A | 5/1997 | Negley | |
| 5,912,477 | A | 6/1999 | Negley | |
| 7,144,140 | B2 * | 12/2006 | Sun et al. | 362/373 |
| 7,213,940 | B1 | 5/2007 | Van De Ven et al. | |
| 7,458,706 | B1 | 12/2008 | Liu et al. | |
| 7,549,774 | B2 * | 6/2009 | Tsai | 362/294 |
| 8,292,464 | B2 * | 10/2012 | Hung | B21D 53/02 362/294 |
| 2005/0174780 | A1 * | 8/2005 | Park | 362/294 |
| 2006/0227558 | A1 * | 10/2006 | Osawa et al. | 362/351 |
| 2007/0137074 | A1 | 6/2007 | Van de Ven | |
| 2007/0139923 | A1 | 6/2007 | Negley | |

(Continued)

FOREIGN PATENT DOCUMENTS

| | | |
|---|---|---|
| CN | 101408300 A | 4/2009 |
| WO | 2008/025161 | 3/2008 |
| WO | 2009/077010 | 6/2009 |

*Primary Examiner* — Nimeshkumar Patel
*Assistant Examiner* — Christopher Raabe
(74) *Attorney, Agent, or Firm* — Burr & Brown, PLLC

(57) ABSTRACT

A lighting device comprising at least a first light emitter, at least a first heat transfer element, and a plurality of heat dissipation elements. Each heat dissipation element has at least a first region and a second region, the first region being in contact with the first heat transfer element, the second region being closer to the first light emitter than the first region. The first light emitter is thermally coupled to the first heat transfer element.

36 Claims, 7 Drawing Sheets

(56) References Cited

U.S. PATENT DOCUMENTS

| | | | |
|---|---|---|---|
| 2007/0170447 | A1 | 7/2007 | Negley |
| 2007/0171145 | A1 | 7/2007 | Coleman |
| 2007/0236911 | A1 | 10/2007 | Negley |
| 2007/0263393 | A1 | 11/2007 | Van de Ven |
| 2007/0274063 | A1 | 11/2007 | Negley |
| 2007/0274080 | A1 | 11/2007 | Negley |
| 2007/0278934 | A1 | 12/2007 | Van de Ven |
| 2007/0279440 | A1 | 12/2007 | Negley |
| 2007/0279903 | A1 | 12/2007 | Negley |
| 2007/0280624 | A1 | 12/2007 | Negley |
| 2008/0007954 | A1 | 1/2008 | Li |
| 2008/0084685 | A1 | 4/2008 | Van de Ven |
| 2008/0084700 | A1 | 4/2008 | Van de Ven |
| 2008/0084701 | A1 | 4/2008 | Van de Ven |
| 2008/0088248 | A1 | 4/2008 | Myers |
| 2008/0089053 | A1 | 4/2008 | Negley |
| 2008/0106895 | A1 | 5/2008 | Van de Ven |
| 2008/0106907 | A1 | 5/2008 | Trott |
| 2008/0112168 | A1 | 5/2008 | Pickard |
| 2008/0112170 | A1 | 5/2008 | Trott |
| 2008/0112183 | A1 | 5/2008 | Negley |
| 2008/0130298 | A1 | 6/2008 | Negley |
| 2008/0137347 | A1 | 6/2008 | Trott |
| 2008/0205062 | A1 | 8/2008 | Dahm et al. |
| 2008/0278950 | A1 | 11/2008 | Pickard |
| 2008/0278952 | A1 | 11/2008 | Trott |
| 2008/0278957 | A1 | 11/2008 | Pickard |
| 2008/0304261 | A1 | 12/2008 | Van de Ven |
| 2008/0304269 | A1 | 12/2008 | Pickard |
| 2008/0309255 | A1 | 12/2008 | Myers |
| 2009/0052175 | A1 | 2/2009 | Xu et al. |
| 2009/0086480 | A1* | 4/2009 | Chen ..... F21V 7/0008 362/235 |
| 2009/0097241 | A1 | 4/2009 | Xu et al. |
| 2009/0108269 | A1 | 4/2009 | Negley |
| 2009/0184666 | A1 | 7/2009 | Myers |
| 2010/0103678 | A1 | 4/2010 | Van de Ven |
| 2010/0277901 | A1 | 11/2010 | Farchtchian et al. |
| 2013/0083520 | A1* | 4/2013 | Booth ..... F21V 29/02 362/234 |

* cited by examiner

LIGHTING DEVICE WITH HEAT DISSIPATION ELEMENTS

FIELD OF THE INVENTIVE SUBJECT MATTER

The present inventive subject matter is directed to a lighting device, in particular to a lighting device with heat dissipation elements.

BACKGROUND

There is an ongoing effort to develop systems that are more energy-efficient. A large proportion (some estimates are as high as twenty-five percent) of the electricity generated in the United States each year goes to lighting. Accordingly, there is an ongoing need to provide lighting which is more energy-efficient.

Persons of skill in the art are familiar with a variety of types of light emitters for use in lighting devices.

It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes. Solid state light emitters (e.g., light emitting diodes) are receiving much attention due to their energy efficiency.

As compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes (e.g., 10,000-20,000 hours) than incandescent lights, but provide less favorable color reproduction. The impact of the need to replace light emitters is particularly pronounced where access is difficult (e.g., vaulted ceilings, bridges, high buildings, traffic tunnels) and/or where change-out costs are extremely high.

Although the development of light emitting diodes has in many ways revolutionized the lighting industry, some of the characteristics of light emitting diodes have presented challenges, some of which have not yet been fully met.

Efforts have been ongoing to develop lighting devices that are improved, e.g., with respect to energy efficiency, color rendering index (CRI Ra), contrast, efficacy (lm/W), and/or duration of service. In addition, efforts have been ongoing to develop lighting devices that include solid state light emitters instead of other forms of light emitters.

BRIEF SUMMARY OF THE INVENTIVE SUBJECT MATTER

The present inventive subject matter provides structures that assist in addressing heat generation issues in lighting devices, and lighting devices that include such structures. While the present inventive subject matter is especially useful for lighting devices that include solid state light emitters, it is applicable to lighting devices that include any forms of lighting devices.

Incandescent bulbs and other light sources produce a great deal of heat when in use. Incandescent light bulbs use filaments that operate at very high temperature (hundreds of degrees C.) enclosed within a glass envelope.

The need to adequately remove heat generated by the light source is particularly pronounced with respect to solid state light emitters. Light emitting diodes, for example, have operating lifetimes of decades (as opposed to just months or one or two years for many incandescent bulbs), but a light emitting diode's lifetime is usually significantly shortened if it operates at elevated temperatures. A common manufacturer recommendation is that the junction temperature of a light emitting diode should not exceed 85 degrees C. if a long lifetime is desired.

In addition, the intensity of light emitted from some solid state light emitters varies based on ambient temperature. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and Blue InGaN+YAG:Ce light emitting diodes can reduce by about −0.15%/degree C.).

In many instances where lighting devices include solid state light emitters as light sources (e.g., general illumination devices which emit white light in which the light sources consist of light emitting diodes), a plurality of solid state light emitters are provided which emit light of different colors which, when mixed, are perceived as the desired color for the output light (e.g., white or near-white). As noted above, the intensity of light emitted by many solid state light emitters, when supplied with a given current, can vary as a result of temperature change. The desire to maintain a relatively stable color of light output is therefore an important reason to try to reduce temperature variation of solid state light emitters.

In addition, the potential for variation in intensity of solid state light emitters (e.g., depending on the ambient temperature and/or the age of the solid state light emitter) has in many instances led to the inclusion in some lighting devices which include solid state light emitter of one or more sensors which detect (1) the color of the light being emitted from the lighting device, and/or (2) the intensity of the light being emitted from one or more of the solid state light emitters, and/or (3) the intensity of light of one or more specific hues of color. By providing such sensors, it is possible to adjust the current supplied to one or more of the solid state light emitters, based on the readings from such sensor(s), in order to maintain the color of the output light within a desired range of color.

With lighting devices that include light emitting diodes, the lower the thermal resistance from the light emitting diode to the environment, the greater light that can be generated from a lighting device without exceeding the optimum maximum junction temperature (or, similar amounts of light can be generated with a lower light emitting diode junction temperature, possibly enabling longer light emitting diode life). Typical passive thermal solutions, such as extruded or cast heat sinks, are simple and effective, but use a significant amount of material in order to conduct the required amount of heat away from the lighting device.

In many cases, the material directly in contact with the light emitting diodes or with the circuit board on which the light emitting diodes are mounted needs to have sufficient cross-sectional area to conduct the heat effectively to the heat sink (so, for example, where an extruded heat sink might need fins that are of a thickness of 1.5 mm in order to conduct heat from the base of the extrusion into the environment, it might require a metal base that is 5 mm thick, 6 mm thick or even thicker in order to conduct heat from the light emitting diodes to the fins).

In many cases, traditional extruded heat sinks require a large amount of space, almost exclusively above the plane of a light emitting diode circuit board. In some cases, the circuit board is mounted to a flat surface to provide effective conduction, and the heat sink fins function more effectively when pointed up (opposite gravity), rather than down, and so in many of such devices, the circuit board is attached to the opposite face of the heat sink from the fins, with the fins extending in an upward direction. It is desirable, however, for the total height of a fixture (or depth that the fixture intrudes into the ceiling) to be limited, or even minimized. As building codes have become more stringent and builders have become more competitive, open space above the ceiling plane for lighting fixtures has in many situations decreased. Many buyers, therefore, have a preference for lighting fixtures that are five inches (about 125 mm) or less in height. If an extruded heat sink that is one or one and a half inches in height are sought to be used, e.g., in combination with an optical cutoff of three inches or more, the design requirements can become extremely difficult or impossible to meet.

In one aspect of the present inventive subject matter, there is provided a lighting device comprising at least a first heat transfer element.

In another aspect of the present inventive subject matter, there is provided a lighting device comprising a plurality of heat dissipation elements.

In some embodiments according to the present inventive subject matter, there is provided a lighting device comprising:

at least a first light emitter;

at least a first heat transfer element; and a plurality of heat dissipation elements, each heat dissipation element having at least a first region and a second region, the first region being in contact with the first heat transfer element, the second region being closer to the first light emitter than the first region, the first light emitter being thermally coupled to and/or mounted on the first heat transfer element.

The expression "thermally coupled", as used herein, means that heat transfer occurs between (or among) the two (or more) items that are thermally coupled. Such heat transfer encompasses any and all types of heat transfer, regardless of how the heat is transferred between or among the items. That is, the heat transfer between (or among) items can be by conduction, convection, radiation, or any combinations thereof, and can be directly from one of the items to the other, or indirectly through one or more intervening elements or spaces (which can be solid, liquid and/or gaseous) of any shape, size and composition. The expression "thermally coupled" encompasses structures that are "adjacent" (as defined herein) to one another. In some situations/embodiments, the majority of the heat transferred from the light source is transferred by conduction; in other situations/embodiments, the majority of the heat that is transferred from the light source is transferred by convection; and in some situations/embodiments, the majority of the heat that is transferred from the light source is transferred by a combination of conduction and convection.

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal gap, thermal grease, etc.

In some embodiments according to the present inventive subject matter, the first light emitter is a solid state light emitter, e.g., a light emitting diode.

In some embodiments, the lighting devices according to the present inventive subject matter can allow for minimal material height above the plane of the light emitters) (and/or above the plane of a circuit board, e.g., a circuit board on which light emitting diodes are mounted), can allow for significantly reduced material usage, can significantly increase the effectiveness of surface area exposed to the environment, can utilize space that would otherwise be "dead space" in the design for thermal management, can allow for easy handling by an installer, and/or can provide a clean and/or aesthetically appealing appearance.

The inventive subject matter may be more fully understood with reference to the accompanying drawings and the following detailed description of the inventive subject matter.

BRIEF DESCRIPTION OF THE DRAWING FIGURES

DETAILED DESCRIPTION OF THE INVENTIVE SUBJECT MATTER

Figure 1:
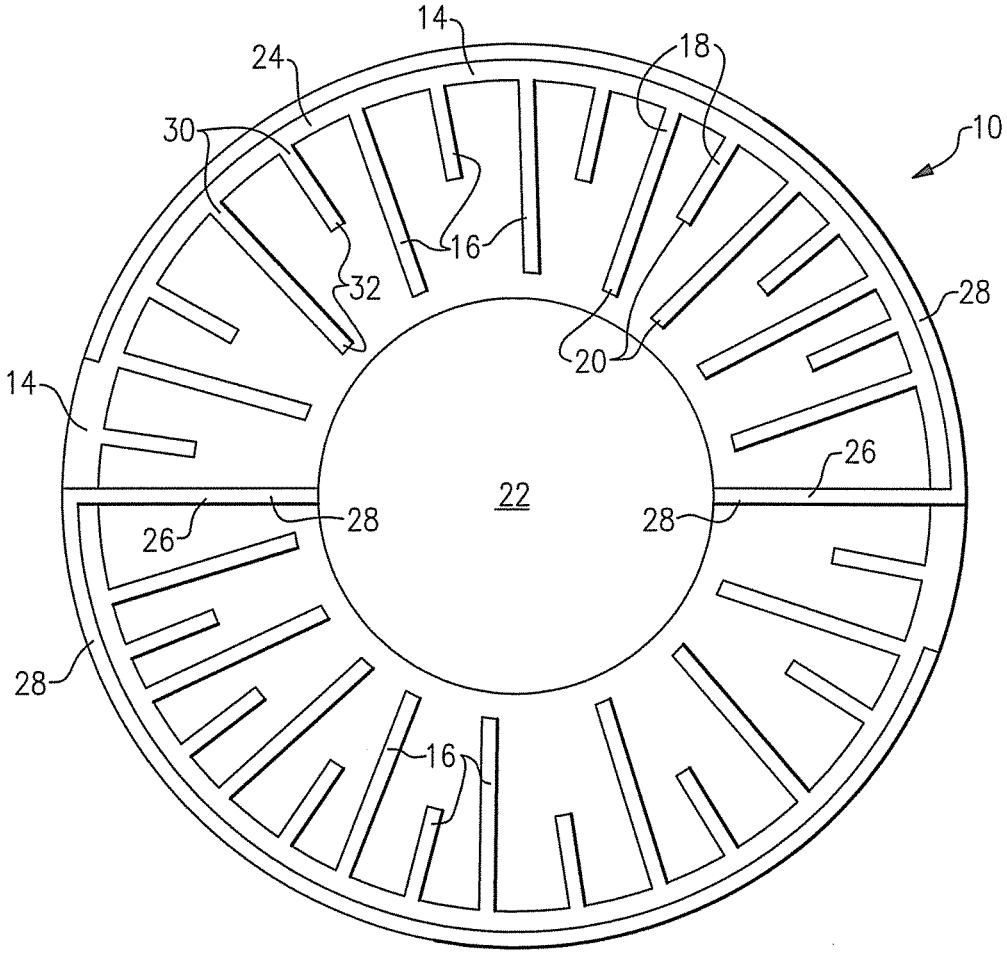
FIG. 1 is a top view of a lighting device according to the present inventive subject matter.

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items. All numerical quantities described herein are approximate and should not be deemed to be exact unless so stated.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present.

In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously, or intermittently at a rate such that a human eye would perceive it as emitting light continuously or intermittently, or where a plurality of solid state light emitters of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The expression "annular", as used herein, means a structure which extends around an unfilled region, and which can otherwise be of any general shape, and any cross-sections can be of any shape. For example, "annular" encompasses ring-like shapes which can be defined by rotating a circle about an axis in the same plane as, but spaced from, the circle. "Annular" likewise encompasses shapes which can be defined by rotating a square (or any other two-dimensional shape) about an axis in the same plane as, but space from, the square. "Annular" likewise encompasses shapes which can be defined by moving any shape from a first position, through space along any path without ever moving to a position where part of the shape occupies a space previously occupied by any part of the shape, and eventually returning to the first position. "Annular" likewise encompasses shapes which can be defined by moving any shape from a first position, through space along any path without ever moving to a position where part of the shape occupies a space previously occupied by any part of the shape, and eventually returning to the first position, and where the shape and size of the shape being moved can be altered at any time, and any number of times, during its movement. The expression "substantially annular" means that at least 95% of the shape which is referred to as being substantially annular is within the bounds of a shape defined herein as being annular, and/or that structure that is substantially annular can include one or more gaps.

The expression "adjacent", as used herein to refer to a spatial relationship between a first structure and a second structure, means that the first and second structures are next to each other. That is, where the structures that are described as being "adjacent" to one another are similar, no other similar structure is positioned between the first structure and the second structure (for example, where two dissipation elements are adjacent to each other, no other dissipation element is positioned between them). Where the structures that are described as being "adjacent" to one another are not similar, no other structure is positioned between them.

The expression "substantially similar length" means that a first element has a length that is between 0.90 to 1.10 times the length of the other element.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

As noted above, in some embodiments according to the present inventive subject matter, there is provided a lighting device comprising at least a first light emitter, at least a first heat transfer element and a plurality of heat dissipation elements, where each heat dissipation element has at least a first region and a second region, the first region being in contact with the first heat transfer element, the second region being closer to the first light emitter than the first region, and where the first light emitter is thermally coupled to and/or mounted on the heat transfer element.

Various embodiments of the present inventive subject matter can comprise at least one light emitter. In such embodiments, the at least one light emitter can be any desired light emitter (or any desired combination of light emitters). Persons of skill in the art are familiar with, and have ready access to, and can envision a wide variety of light emitters, and combinations of light emitters, and any of such light emitters and combinations of light emitters can be employed in accordance with the present inventive subject matter. The at least one light emitter can consist of a single source of light, or can comprise a plurality of sources of light which can be any combination of the same types of components and/or different types of light emitters, and which can be any combination of emitters that emit light of the same or similar wavelength(s) (or wavelength ranges), and/or of different wavelength(s) (or wavelength ranges).

Persons of skill in the art are familiar with a wide variety of light emitters, and any desired light emitter, or combination of light emitters, can be employed in accordance with the present inventive subject matter. Representative examples of types of light emitters include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc.

In some embodiments, the at least one light emitter comprises one or more solid state light emitters (and optionally may additionally comprise one or more luminescent materials). In some embodiments, the at least one light emitter comprises at least two solid state light emitters that emit light of different colors.

A variety of solid state light emitters are well known, and any of such solid state light emitters can be employed according to the present inventive subject matter. Representative examples of solid state light emitters include light emitting diodes (inorganic or organic, including polymer light emitting diodes (PLEDs)) with or without luminescent materials. Persons of skill in the art are familiar with, and have ready access to, a variety of solid state light emitters which, when illuminated, emit light of any of a wide variety of wavelengths, ranges of wavelengths, dominant emission wavelengths and peak emission wavelength, and any of such solid state light emitters, or any combinations of such solid state light emitters, can be employed as at least one light emitter in accordance with the present inventive subject matter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Persons of skill in the art are familiar with, and have ready access to, a variety of luminescent materials that emit light having a desired peak emission wavelength and/or dominant emission wavelength, or a desired hue, and any of such luminescent materials (discussed in more detail below), or any combinations of such luminescent materials, can be employed in embodiments that comprise luminescent material. For example, a variety of phosphors are readily available, such phosphors each being a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material that converts photons to a lower energy level (longer wavelength) or up-converting, i.e., a material which converts photons to a higher energy level (shorter wavelength).

In embodiments where the lighting device includes one or more luminescent materials, the expression "illuminated" (or "illumination" or the like) can include light that has been up-converted or down-converted by one or more luminescent materials.

In some embodiments, one or more luminescent material can be included within a packaged solid state light emitter in any of a variety of ways known to persons of skill in the art, one representative way being by adding the luminescent materials to a clear or transparent encapsulant material (e.g., epoxy-based, silicone-based, glass-based or metal oxidebased material) as discussed above, for example by a blending or coating process, prior to solidifying the encapsulant material.

For example, one representative example of a conventional solid state light emitter lamp that comprises a solid state light emitter and luminescent material includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion in which a luminescent material is dispersed, the first resin portion being further encapsulated with a second resin portion. The first resin portion can be obtained by filling the cup reflector with a resin material and curing it after the light emitting diode chip has been mounted onto the bottom of the cup reflector and then has had its cathode and anode electrodes electrically connected to the leads by way of wires. The luminescent material can be dispersed in the first resin portion so as to be excited with the light A that has been emitted from the light emitting diode chip, the excited luminescent material produces fluorescence ("light B") that has a longer wavelength than the light A, a portion of the light A is transmitted through the first resin portion including the luminescent material, and as a result, light C, as a mixture of the light A and light B, is used as illumination.

Representative examples of suitable solid state light emitters, including suitable light emitting diodes, luminescent materials, encapsulants, etc., are described in:

U.S. Pat. No. 7,213,940, the entirety of which is hereby incorporated by reference as if set forth in its entirety;

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009-0108269), the entirety of which is hereby incorporated by reference as if set forth in its entirety.

Various embodiments of the present inventive subject matter can comprise at least one heat transfer element.

A heat transfer element can be made of any suitable desired material, and can be of any suitable shape. In some embodiments, a heat transfer element has high thermal conductivity characteristics, e.g., it has a thermal conductivity of at least 1 W/m-K. The heat transfer element may, in some embodiments, be provided as a heat pipe. In other embodiments, the heat transfer element may be provided as a highly thermally conductive material, such as a graphite sheet or graphite foam. Representative examples of materials which are suitable for making a heat transfer element include, among a wide variety of other materials, extruded aluminum, die cast aluminum, liquid crystal polymer, polyphenylene sulfide (PPS), thermoset bulk molded compound or other composite material. Each part of the heat transfer element can be formed of any suitable material or materials, i.e., the entire heat transfer element can be formed of a single material, combinations of materials, or different portions of the heat transfer element (e.g., the substrate region, the heat transfer region, the thermal connector region and/or portions of any of these) can be formed of different materials or different combinations of materials, and can be made in any suitable way or ways. For instance, the substrate region can comprise a heat spreader plate made of any suitable material, the outer region can be made by any suitable method, e.g., by extrusion (in some embodiments, part of the outer region, e.g., all except for portions of the heat pipe that extend along the periphery of the heat transfer element) and the heat dissipation elements can be made as a single extrusion.

In some embodiments according to the present inventive subject matter, including some embodiments that include or do not include any of the features as discussed above, a heat transfer element comprises a substrate region, an outer region and at least a first thermal connector region, a first light emitter is mounted on the substrate region, and the first thermal connector region extends from the substrate region to the outer region of a heat transfer element. In such embodiments, any combination of the one or more substrate region, the one or more outer region and the one or more thermal connector region can be integrally mechanically connected and/or can be attached to each other (e.g., by adhesive, bolts, screws, rivets, etc.).

In some embodiments according to the present inventive subject matter, a first thermal connector region comprises a heat pipe or other low-loss thermal transfer mechanism, such as a graphite sheet or graphite foam member, a variety of which are known to those of skill in the art. In some of these embodiments, the heat pipe extends at least from a substrate region to an outer region, or the heat pipe extends at least from the substrate region to the outer region and at least partially along an outer region of a heat transfer element.

Persons of skill in the art are familiar with heat pipes, which typically comprise a pipe made of a material which readily conducts heat (e.g., copper or aluminum). In many heat pipes, the interior of the heat pipe comprises a working fluid, e.g., water, ethanol, acetone, sodium or mercury, often under partial vacuum. The cross-sectional shape of the heat pipe can be any suitable shape (which may be regular or irregular—e.g., square or circular), and may vary as desired along the length of the heat pipe. In many cases, however, it is desirable for the interior of the heat pipe to be of substantially uniform cross-sectional area along its length and configured to provide for the return of the condensed working fluid from the low temperature region of the heat pipe to the high temperature region of the heat pipe.

A heat pipe employed in a lighting device according to the present inventive subject matter can be of any suitable shape. Representative examples of heat pipes that would be suitable for use in the lighting devices according to the present inventive subject matter are described in U.S. Patent Application No. 61/108,149, filed on Oct. 24, 2008, entitled "LIGHTING DEVICE, HEAT TRANSFER STRUCTURE AND HEAT TRANSFER ELEMENT", the entirety of which is hereby incorporated by reference as if set forth in its entirety. In some embodiments according to the present inventive subject matter, a heat pipe can comprise part of a thermal connector region and part of an outer region.

In some embodiments according to the present inventive subject matter, including some embodiments that include or do not include any of the features as discussed above, a first portion of a first thermal connector region extends from a substrate region to an outer region in a first direction, a second portion of the first thermal connector region extends from the substrate region to the outer region in a second direction, and the first direction is substantially opposite from the second direction. The expression "first direction is substantially opposite from the second direction", as used herein, means that a line extending in the first direction defines an angle of at least 160 degrees with respect to a line extending in the second direction, or a line that is parallel to a line extending in the second direction.

In some embodiments according to the present inventive subject matter, including some embodiments that include or do not include any of the features as discussed above, an outer region defines at least a portion of a periphery of a heat transfer element. In some of such embodiments, the periphery of the heat transfer element is substantially circular annular, substantially square annular, substantially polygonal annular, or any other substantially toroidal shape. The expression "toroidal" is used herein consistently with its conventional usage to refer to a shape which could be generated by rotating a planar closed curve about a line that lies in the same plane as the curve but does not intersect the curve. That is, the expression "toroidal" encompasses doughnut shapes which would be generated by rotating circles about a line that lies in the same plane as the circle, as well as shapes which would be generated by rotating squares, triangles, irregular (abstract) shapes, etc. about a line that lies in the same plane. The expression "substantially toroidal" means that the structure that is substantially toroidal can include one or more gaps.

Various embodiments of the present inventive subject matter can comprise a plurality of heat dissipation elements.

Heat dissipation elements can be made of any suitable desired material, and can be of any suitable shape. In some embodiments, a heat transfer element has high thermal conductivity characteristics, e.g., it has a thermal conductivity of at least 1 W/m-K. Representative examples of materials which are suitable for making a heat transfer element include, among a wide variety of other materials, extruded aluminum, die cast aluminum, liquid crystal polymer, polyphenylene sulfide (PPS), thermoset bulk molded compound or other composite material.

Heat dissipation elements can be made by any suitable method, e.g., by extrusion.

In some embodiments according to the present inventive subject matter, including some embodiments that include or do not include any of the features as discussed above, at least a first heat dissipation element has a first end and a second end, the first end being in thermal communication with and proximate to an outer region of a first heat transfer element. The second end is distal from the outer region of the first heat transfer element. In some of such embodiments, the first heat dissipation element extends from the first end toward a substrate region of the first heat transfer element. In some of these embodiments, a plane of symmetry of the first heat dissipation element passes through a first light emitter.

In some embodiments according to the present inventive subject matter, including some embodiments that include or do not include any of the features as discussed above, a first heat dissipation element has a width dimension that is not more than one fifth as large as a height dimension of the first heat dissipation element and not more than one fifth as large as a depth dimension of the first heat dissipation element (in other words, the heat dissipation element is relatively thin and/or flat). The width dimension, height dimension and depth dimension are arranged orthogonally to one another, i.e., like x, y and z axes.

In some embodiments according to the present inventive subject matter, including some embodiments that include or do not include any of the features as discussed above, a spacing between a first region of a first dissipation element and a first region of a second dissipation element is larger than a spacing between a second region of the first dissipation element and a second region of the second dissipation element.

In some embodiments according to the present inventive subject matter, including some embodiments that include or do not include any of the features as discussed above, a spacing between a first heat dissipation element and a second heat dissipation element is smaller at farther distances from an outer region of a heat transfer element.

In some embodiments according to the present inventive subject matter, including some embodiments that include or do not include any of the features as discussed above:

a first dissipation element has a first dissipation element first end and a first dissipation element second end, the first dissipation element first end is spaced from the first dissipation element second end by a first distance, a second dissipation element has a second dissipation element first end and a second dissipation element second end, the second dissipation element first end is spaced from the second dissipation element second end by a second distance, and the first distance is larger than the second distance.

In some of such embodiments:

the first heat dissipation element extends from the first dissipation element first end toward a substrate region of a first heat transfer element, and the second heat dissipation element extends from the second dissipation element first end toward a substrate region of the first heat transfer element.

In some embodiments according to the present inventive subject matter, including some embodiments that include or do not include any of the features as discussed above:

each of a plurality of first dissipation elements has a first dissipation element first end and a first dissipation element second end, for each first dissipation element, the first dissipation element first end is spaced from the first dissipation element second end by about a first distance, each of a plurality of second dissipation elements has a second dissipation element first end and a second dissipation element second end, for each second dissipation element, the second dissipation element first end is spaced from the second dissipation element second end by about a second distance, and the first distance is larger than the second distance.

In some embodiments according to the present inventive subject matter, including some embodiments that include or do not include any of the features as discussed above, more than one heat dissipation element has one or more of the features described above for a heat dissipation element (or elements).

Any or all of the heat dissipation elements can be integral with the heat transfer element and/or can be attached to it (e.g., by adhesive, bolts, screws, rivets, etc.). Furthermore, multiple ones of the heat dissipation elements may be provided as part of a unitary structure, such as an annular structure with heat dissipation elements extending from the annular structure.

In some embodiments according to the present inventive subject matter, including some embodiments that include or do not include any of the features as discussed above, the lighting device further comprises a housing that defines a light mixing chamber.

The housing of the present inventive subject matter (when included) can be any suitable housing or fixture, and can be made of any suitable material and in any suitable shape. Skilled artisans are familiar with a wide variety of housings and fixtures, any of which can be employed in connection with the present inventive subject matter.

In some embodiments, a housing can be formed of a material which is an effective heat sink (i.e., which has high thermal conductivity and/or high heat capacity) and/or which is reflective (or which is coated with a reflective material). A representative example of a material out of which the fixture housing can be made is sheet metal. In some embodiments, a housing can include a reflective element (and/or one or more of its surfaces are reflective), so that light is reflected by such reflective surfaces. Such reflective elements (and surfaces) are well-known and readily available to persons skilled in the art. A representative example of a suitable material out of which a reflective element can be made is a material marketed by Furukawa (a Japanese corporation) under the trademark MCPET®.

For example, fixtures, other mounting structures, mounting schemes, housings and complete lighting assemblies which may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/613,733, filed Dec. 20, 2006 (now U.S. Patent Publication No. 2007/0137074) the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT", the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety; and U.S. patent application Ser. No. 12/116,348, filed on May 7, 2008 (now U.S. Patent Publication No. 2008/0278957), the entirety of which is hereby incorporated by reference as if set forth in its entirety.

In some embodiments according to the present inventive subject matter, including some embodiments that include or do not include any of the features as discussed above, an entirety of each of the heat dissipation elements is spaced from a housing i.e., they do not touch the housing. Providing heat dissipating elements that are spaced from a housing can allow for air to flow through the heat transfer element. In addition, attaching heat dissipating elements to an outer region of a heat transfer element and spacing them from a housing can allow for cooler air to impinge upon a larger heat dissipating element surface area.

A housing may be mechanically attached to a heat transfer element in any suitable way, e.g., with screws, or any other attachment means. In some embodiments, for example, a housing and a light emitter are both mounted on a substrate region second side.

In some embodiments according to the present inventive subject matter, including some embodiments that include or do not include any of the features as discussed above, a substrate has a first side and a second side, a first light emitter is mounted on the second side of the substrate, and a light mixing chamber extends from the second side of the substrate.

The present inventive subject matter is applicable to lighting devices of any size or shape capable of incorporating the described heat transfer structure, including flood lights, spot lights, and all other general residential or commercial illumination products.

Any lighting device in accordance with the present inventive subject matter can comprise one or more lenses. Persons of skill in the art are familiar with a wide variety of materials out of which lenses can be made, and are familiar with a wide variety of shapes that such lenses can be, and any of such materials and shapes can be employed in embodiments according to the present inventive subject matter that include a lens (or plural lenses). As will be understood by persons skilled in the art, a lens in a lighting device according to the present inventive subject matter can have any desired effect on incident light (or no effect), such as focusing, diffusing, etc.

In embodiments in accordance with the present inventive subject matter that include a lens (or plural lenses), the lens (or lenses) can be positioned in any suitable location and orientation.

In some lighting devices according to the present inventive subject matter, there are further included one or more circuitry components, e.g., drive electronics for supplying and controlling current passed through at least one of the solid state light emitters in the lighting device. Persons of skill in the art are familiar with a wide variety of ways to supply and control the current passed through solid state light emitters, and any such ways can be employed in the devices of the present inventive subject matter. For example, such circuitry can include at least one contact, at least one leadframe, at least one current regulator, at least one power control, at least one voltage control, at least one boost, at least one capacitor and/or at least one bridge rectifier, persons of skill in the art being familiar with such components and being readily able to design appropriate circuitry to meet whatever current flow characteristics are desired.

Representative examples of apparatuses for supplying electricity to lighting devices and power supplies for lighting devices, all of which are suitable for the lighting devices and lighting arrangements of the present inventive subject matter, are described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety; and U.S. patent application Ser. No. 12/328,144, filed Dec. 4, 2008 (now U.S. Patent Publication No. 2009/0184666), the entirety of which is hereby incorporated by reference as if set forth in its entirety.

The lighting devices according to the present inventive subject matter can further comprise any desired electrical connector, a wide variety of which are familiar to those of skill in the art, e.g., an Edison connector (for insertion in an Edison socket), a GU-24 connector, etc., or may be directly wired to an electrical branch circuit.

In some embodiments according to the present inventive subject matter, the lighting device is a self-ballasted device. For example, in some embodiments, the lighting device can be directly connected to AC current (e.g., by being plugged into a wall receptacle, by being screwed into an Edison socket, by being hard-wired into a branch circuit, etc.). Representative examples of self-ballasted devices are described in U.S. patent application Ser. No. 11/947,392, filed on Nov. 29, 2007 (now U.S. Patent Publication No. 2008/0130298), the entirety of which is hereby incorporated by reference as if set forth in its entirety.

In some embodiments in accordance with the present inventive subject matter, some or all of the energy supplied to the at least one light source and/or the first group of solid state light emitters is supplied by one or more batteries and/or by one or more photovoltaic energy collection device (i.e., a device which includes one or more photovoltaic cells which converts energy from the sun into electrical energy).

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Figure 2:
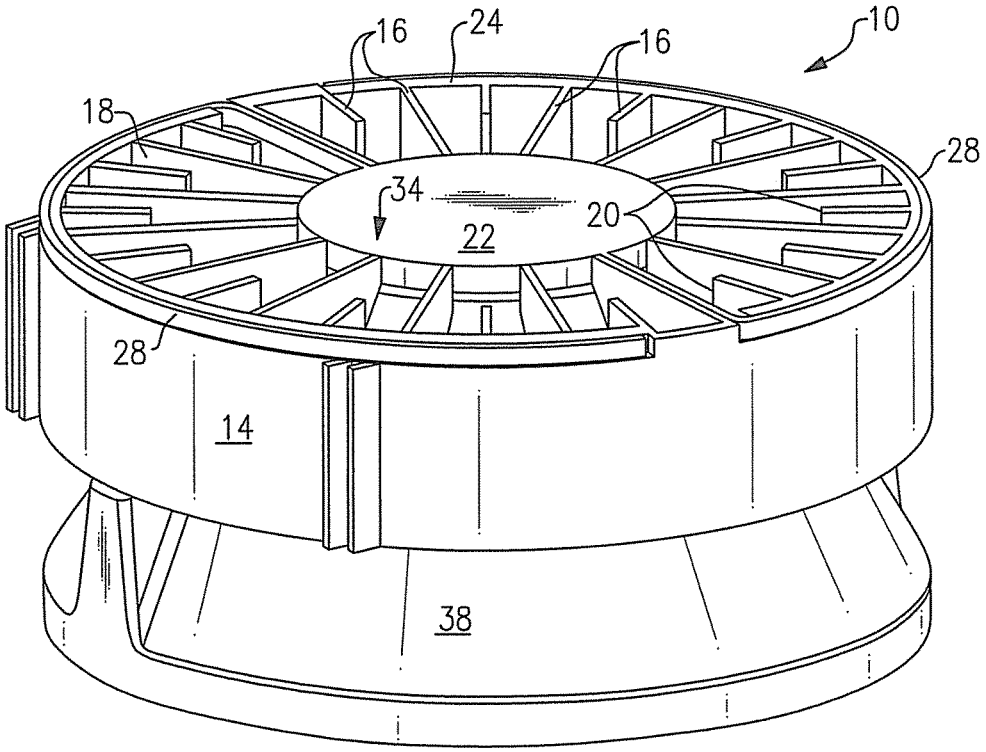
FIG. 2 is a perspective view of the lighting device of FIG. 1.
Figure 3:
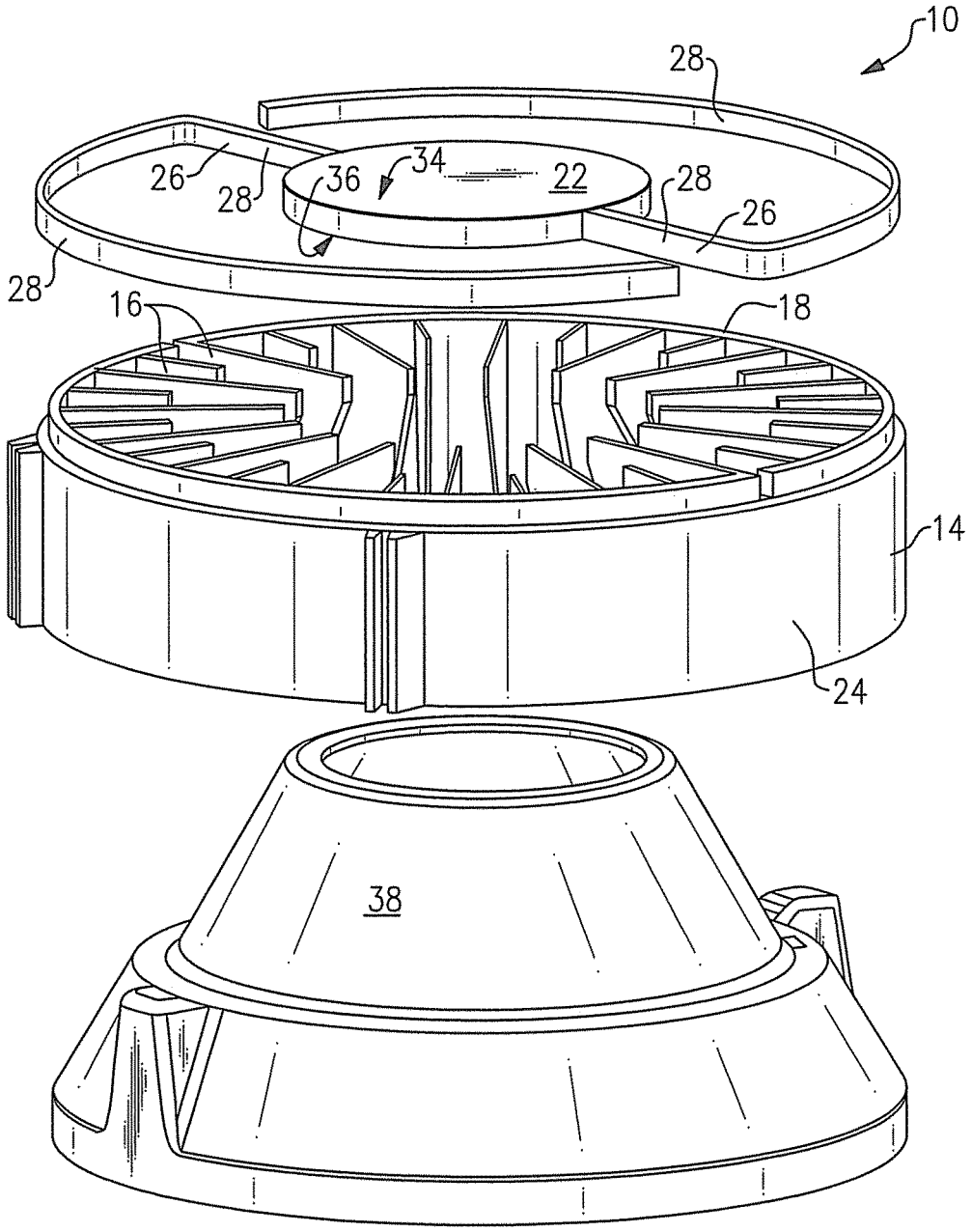
FIG. 3 is an exploded perspective view of the lighting device of FIG. 1.
Figure 4:
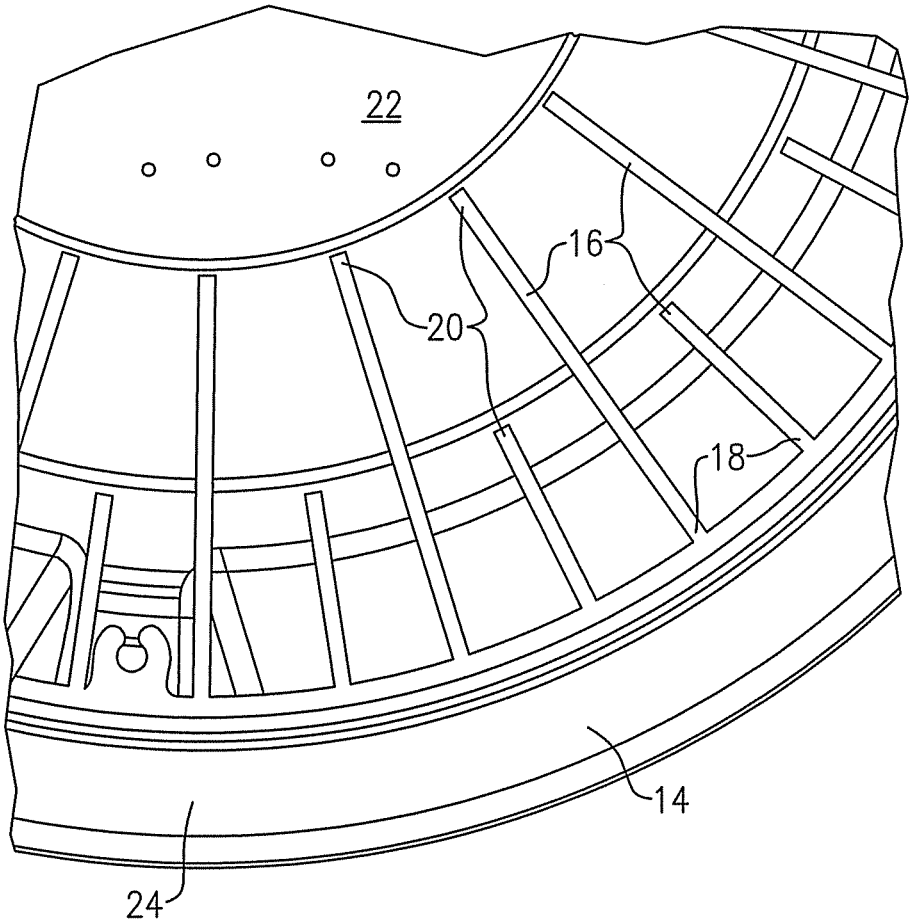
FIG. 4 is a close-up view of a portion of a top view of the lighting device of FIG. 1.
Figure 5:
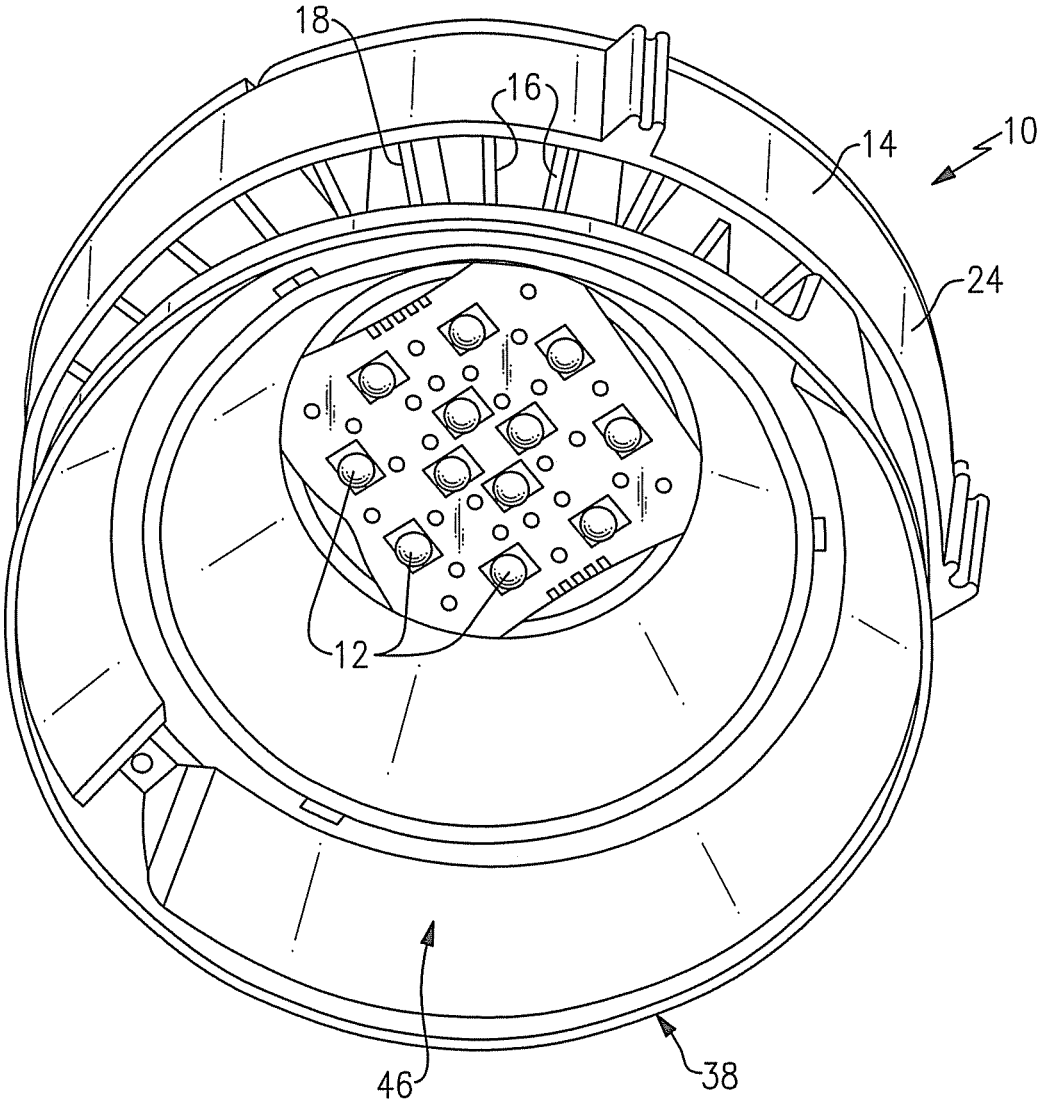
FIG. 5 is a perspective view of the lighting device of FIG. 1, looking upward (from the orientation depicted in FIG. 3) into the housing of the lighting device of the first embodiment.
Figure 6:
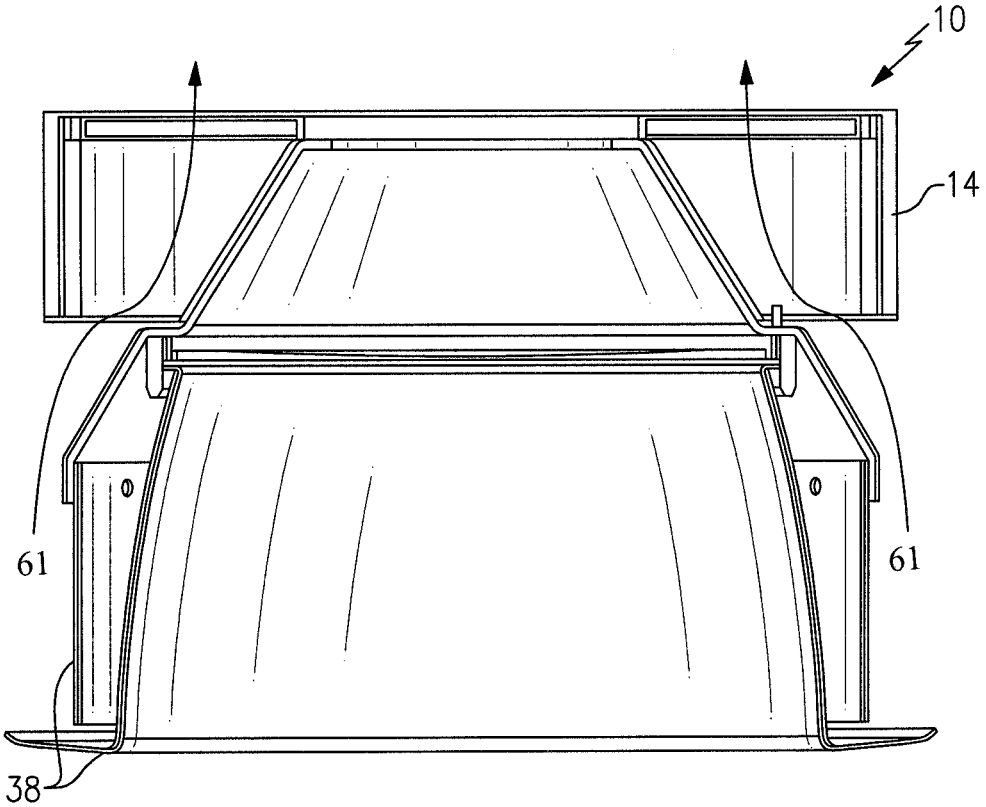
FIG. 6 is a cross-sectional view of the lighting device of FIG. 1.

FIGS. 1-6 illustrate a lighting device 10 in accordance with the present inventive subject matter. FIG. 1 is a top view of the lighting device 10. FIG. 2 is a perspective view of the lighting device 10. FIG. 3 is an exploded perspective view of the lighting device 10. FIG. 4 is a close-up view of a portion of a top view of the lighting device 10. FIG. 5 is a perspective view of the lighting device 10, looking upward (from the orientation depicted in FIG. 3) into the housing 38 of the lighting device 10. FIG. 6 is a cross-sectional view of the lighting device 10.

The lighting device 10 comprises a plurality of light emitters 12, a heat transfer element 14 and a plurality of heat dissipation elements 16. The heat transfer element 14 comprises a substrate region 22, an outer region 24 and first and second thermal connector regions 26. The substrate region 22 has a first side 34 and a second side 36. The light emitters 12 are mounted on the second side 36 of the substrate region 22, and the thermal connector regions 26 each extend from the substrate region 22 to the outer region 24.

Each heat dissipation element 16 has at least a first region 18 and a second region 20, the first region 18 being in contact with the heat transfer element 14, the second region 20 being closer to the light emitters 12 than the first region 18.

The first light emitters 12 can be solid state light emitters, e.g., light emitting diodes.

A heat pipe 28 extends through the substrate region 22 (in some embodiments, the heat pipe 28 can extend straight through, and in other embodiments, it is "snaked through", i.e., it bends as much as desired so as to have as much surface area within the substrate region 22 as is desired to absorb the desired amount of heat and to pass through specific regions that might be hot spots) and extends in both directions from the substrate region 22. A portion of the heat pipe 28 that extends in a first direction from the substrate region 22 forms a first thermal connector region 26 (or a first portion of the thermal connector region), and then extends along a portion (nearly an entire half) of a periphery of the outer region 24. A portion of the heat pipe 28 that extends in the other direction (which can be opposite from the first direction) from the substrate region 22 forms a second thermal connector region 26 (or a second portion of the thermal connector region), and then extends along a portion (nearly the entire other half) of the periphery of the outer region 24.

The outer region 24 defines at least a portion of a periphery of the heat transfer element 14. In this embodiment, the periphery of the heat transfer element 14 can be substantially circular annular. In other embodiments, as desired, the periphery of the heat transfer element can be any other desired shape, e.g., substantially square annular, etc.

Each of the heat dissipation elements 16 has a first end 30 and a second end 32, the first end 30 of each being in contact with the outer region 24 of the heat transfer element 14. Each of the heat dissipation elements 16 can extend from its first end 30 toward the substrate region 22 of the heat transfer element 14. In some embodiments, a plane of symmetry of one or more of the heat dissipation elements 16 passes through one or more of the light emitters 12. Any or all of the heat dissipation element 16 can have a width dimension that is not more than one fifth as large as a height dimension and not more than one fifth as large as a depth dimension of the heat dissipation element 16.

The lighting device 10 in this embodiment includes heat dissipation elements 16 that are of one of two lengths, i.e., the lighting device 10 includes shorter heat dissipation elements and longer heat dissipation elements. The heat dissipation elements are arranged such that each longer heat dissipation element is between two shorter heat dissipation elements (and vice-versa).

For each heat dissipation element, relative to the nearest other heat dissipation element of similar length, the spacing between the first regions of the respective heat dissipation elements is larger than the spacing between the second regions of the respective heat dissipation elements.

For each heat dissipation element, relative to the nearest other heat dissipation element of similar length, the spacing between the respective heat dissipation elements is smaller at farther distances from the outer region 24.

The housing 38 defines a light mixing chamber 46. Each of the heat dissipation elements 16 is in its entirety spaced from the housing 46, i.e., none of the heat dissipation elements 16 are in direct contact with the housing 46 at any portion of the heat dissipation element 16. The light mixing chamber 46 extends from the second side 36 of the substrate region 22.

Referring to FIG. 4, in the lighting device 10, the heat dissipation elements 16 (in this embodiment, they can also referred to as "fins") extend from a periphery of the device toward the interior (and heat is distributed about the periphery by the heat pipe 28 or other low-loss mechanism), and so the widest spacing of the fins is necessarily at the periphery where the temperatures are the highest. This allows for the potential addition of intermediate fins such as are shown in FIG. 4. By providing an "inside-out" heat sink as shown in the present drawing Figures, the surface area that is effective for convective heat transfer can be increased or maximized within a vertical fin volume, and such can be achieved in a way that has the potential to have more of that surface area at higher temperatures with access to cooler airflows.

FIG. 6 depicts with arrows airflows 61 being pulled convectively through the lighting device 10.

Figure 7:
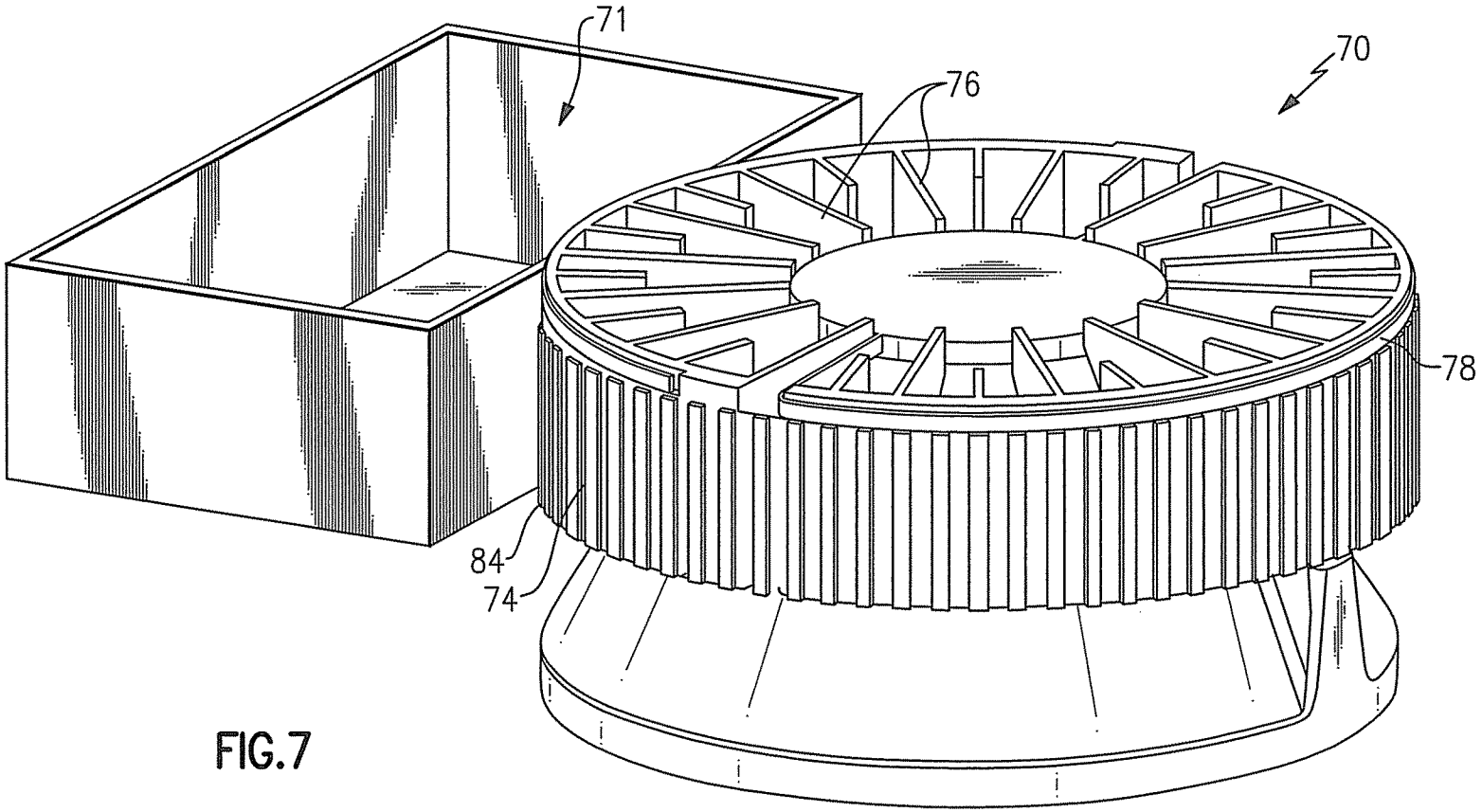
FIG. 7 is a perspective view of a lighting device according to further embodiments of the present inventive subject matter.

FIG. 7 illustrates embodiments of a lighting device 70 in accordance with the present inventive subject matter. The lighting device 70 is similar to the lighting device 10, except that the lighting device 70 further comprises a power supply area 71 in which one or more power supply components can be positioned. The power supply area 71 can be integral with the outer region 84 of the heat transfer element 74, e.g., as a result of being co-extruded with the outer region 84 (except for the portion of the heat pipe 78 that extends along the periphery of the lighting device, which is part of the outer region 84) of the heat transfer element 74 and the heat dissipation elements 76.

As seen in FIGS. 1 through 7, the present inventive subject matter can provide heat dissipation structures that extend forward along the path of light exiting a lighting device. Thus, the impact on the overall depth of the lighting device may be reduced over conventional heat dissipation structures that extend behind the light sources. Accordingly, the present inventive subject matter can provide heat dissipation structures that have over 50% of their total height in front of a plane of the light sources. The present inventive subject matter can also provide heat dissipation structures that have over 75% or even over 90% of their total height in front of a plane of the light sources.

In addition, because the heat is transferred to an outer portion of the heat dissipation structure before it is distributed to the heat dissipation elements, the overall height of these heat dissipation elements may be increased as the interference distance with a sloped mixing structure increases with increasing radial distance. Thus, additional surface area for heat dissipation may be provided by the heat dissipation elements without increasing the overall height of the lighting device. Additionally, this increased height is provided where the greatest temperature occurs on the heat dissipation element, thereby increasing the surface area available for dissipating heat.

Tapering the heat dissipation elements to accommodate the mixing chamber also need not substantially reduce the effectiveness of the heat dissipating elements as the taper is in the direction of decreasing temperature. In contrast, where fins extending radially outward from the center of the lighting device are used, the greatest temperature would be at the center of the device where the fins would be the shortest. Thus, a thermal choke point would result and the increased thickness with increased distance from the center may be less effective than where the heat is first transferred to the outer periphery and then dissipated inward.

A further aspect of certain embodiments of the present inventive subject matter relates to the spacing of the heat dissipating elements. In particular, because the heat is dissipated from the outside toward the inside, the spacing of the heat dissipating elements may be such that all, substantially all, or most of the length of the heat dissipating elements may be effective in dissipating heat. This may be the case because the spacing between the heat dissipating elements may be selected so as to reduce or eliminate interaction between adjacent heat dissipating elements. Additionally, as the heat is dissipated inward along the length of the heat dissipating elements, the spacing between the heat dissipating elements can decrease without causing substantial loss in the effectiveness of neighboring ones of the heat dissipating elements.

In selecting the distance between heat dissipating elements, the distance may be selected so that adjacent heat dissipating elements do not substantially reduce the amount of heat dissipated by each other. Furthermore, the spacing should be sufficient to allow air flow between the heat dissipating elements. Thus, as seen in FIGS. 1 through 7, the longer heat dissipating elements have a shorter heat dissipating element placed between them. This results from the inward radial nature of the longer heat dissipating elements. The distance between the longer heat dissipating elements is closer at their distal ends than it is at the ends proximate the outer periphery. The distance that reduces or minimizes thermal interaction between two adjacent long heat dissipating elements is limited by their spacing at the distal ends. Accordingly, the spacing at their proximate ends is greater than is required merely to thermally decouple adjacent heat dissipating elements. This extra spacing may be advantageously utilized by inserting one or more shorter heat dissipating elements between adjacent longer heat dissipating elements. The shorter heat dissipating elements may extend a distance from the outer periphery until their distal ends are spaced from the adjacent longer where they would begin to have substantial thermal interaction with the adjacent heat dissipating elements. This process of inserting shorter heat dissipating elements could be repeated to the limits of the fabrication technology. Because each successive iteration of the heat dissipating elements has decreased surface area, however, the additional benefit from increased heat dissipation area of a next iteration of heat dissipating elements is eventually outweighed by increased manufacturing complexity.

While not illustrated in the figures, thermal grease, thermal pads, graphite sheets or other techniques known to those of skill in the art may be used to increase the thermal coupling between the thermal transfer element and the heat dissipation element and/or between portions or components of these elements.

In some embodiments of lighting devices according to the present inventive subject matter are capable of dissipating over 30 W worth of heat in a very compact form without any active elements.

In some embodiments of lighting devices according to the present inventive subject matter provide a way to effectively cool a large heat load with as little as 4-5 mm worth of material above the back surface of a light emitting diode circuit board, e.g., a LED MCPCB.

In some embodiments, lighting devices according to the present inventive subject matter, by extending heat sink fins toward the interior of an extruded form rather than the exterior, the overall product is easier to handle during installation, and presents a clean appearance.

In some embodiments, lighting devices according to the present inventive subject matter, good fin spacing is provided, which can be critical to performance of passive cooling devices.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device comprising:

at least a first light emitter;

at least a first heat transfer element having an annular outer region, an inner space defined by and completely surrounded by the outer region, a first plane and a second plane, the first light emitter in the inner space; and a plurality of heat dissipation elements comprising at least a first heat dissipation element and a second heat dissipation element, each heat dissipation element having at least a first region and a second region, the first region in contact with the first heat transfer element, the second region closer to the first light emitter than the first region is, the first heat dissipation element having a first dissipation element first region and a first dissipation element second region, the first dissipation element first region in contact with the first heat transfer element, the first dissipation element second region closer to the first light emitter than the first dissipation element first region is, the second heat dissipation element having a second dissipation element first region and a second dissipation clement second region, the second dissipation element first region in contact with the first heat transfer element, the second dissipation element second region closer to the first light emitter than the second dissipation element first region is, the second dissipation element second region closer to the first light emitter than the first dissipation element second region is, the first heat dissipation element attached only to the first heat transfer element at only the annular outer region of the first heat transfer element, at least the first heat dissipation element extending from the outer region into the inner space, the first light emitter thermally coupled to the first heat transfer element.

2. A lighting device as recited in claim 1, wherein the first light emitter is a solid state light emitter.

3. A lighting device as recited in claim 1, wherein the first light emitter is a light emitting diode.

4. A lighting device as recited in claim 1, wherein:

the first heat transfer element comprises a substrate region, the outer region and at least a first thermal connector region, the first light emitter is mounted on the substrate region, the first thermal connector region extends from the substrate region to the outer region, the substrate region and the outer region are concentric, and the first thermal connector region extends along a diameter of the outer region.

5. A lighting device as recited in claim 4, wherein the first thermal connector region comprises a heat pipe.

6. A lighting device as recited in claim 5, wherein the heat pipe extends at least from the substrate region to the outer region.

7. A lighting device as recited in claim 5, wherein the heat pipe extends at least from the substrate region to the outer region and at least partially along the outer region.

8. A lighting device as recited in claim 4, wherein:

a first portion of the first thermal connector region extends from the substrate region to the outer region in a first direction, a second portion of the first thermal connector region extends from the substrate region to the outer region in a second direction, and the first direction is substantially opposite from the second direction.

9. A lighting device as recited in claim 4, wherein the outer region defines at least a portion of a periphery of the heat transfer element.

10. A lighting device as recited in claim 9, wherein the periphery of the heat transfer element is substantially circular annular.

11. A lighting device as recited in claim 9, wherein the periphery of the heat transfer element is substantially square annular.

12. A lighting device as recited in claim 1, wherein at least a first of the heat dissipation elements has a first end and a second end, the first end in contact with the outer region of the first heat transfer element.

13. A lighting device as recited in claim 12, wherein the first heat dissipation element extends from the first end toward the substrate region of the first heat transfer element.

14. A lighting device as recited in claim 13, wherein a plane of symmetry of the first heat dissipation element passes through the first light emitter.

15. A lighting device as recited in claim 1, wherein the first heat dissipation element has a width dimension that is not more than one fifth as large as a height dimension of the first heat dissipation element and not more than one fifth as large as a depth dimension of the first heat dissipation element.

16. A lighting device as recited in claim 1, wherein a spacing between the first region of the first heat dissipation element and the first region of the second heat dissipation element is larger than a spacing between the second region of the first heat dissipation element and the second region of the second heat dissipation element.

17. A lighting device as recited in claim 1, wherein a spacing between the first heat dissipation element and the second heat dissipation element is smaller at farther distances from the outer region.

18. A lighting device as recited in claim 1, wherein:

each of a first group of dissipation elements has a first dissipation element first end and a first dissipation element second end, for each of the first group of dissipation elements, the first dissipation clement first end is spaced from the first dissipation element second end by about a first distance, each of a second group of dissipation elements has a second dissipation element first end and a second dissipation element second end, for each of the second group of dissipation elements, the second dissipation element first end is spaced from the second dissipation element second end by about a second distance, and the first distance is larger than the second distance.

19. A lighting device as recited in claim 1, wherein each of the heat dissipation elements has a first end and a second end, the first end in contact with the outer region of the first heat transfer element.

20. A lighting device as recited in claim 19, wherein:

the heat transfer element comprises a substrate region, an outer region and at least a first thermal connector region, the first light emitter is mounted on the substrate region, the first thermal connector region extends from the substrate region to the outer region, and each of the heat dissipation elements extends from the first end toward the substrate region of the first heat transfer element.

21. A lighting device as recited in claim 20, wherein each of the heat dissipation elements has a plane of symmetry that passes through the first light emitter.

22. A lighting device as recited in claim 1, wherein each of the heat dissipation elements has a width dimension that is not more than one fifth as large as its height dimension and not more than one fifth as large as its depth dimension.

23. A lighting device as recited in claim 1, wherein for each adjacent pair of dissipation elements, a spacing between the respective first regions is larger than a spacing between the respective second regions.

24. A lighting device as recited in claim 1, wherein for each adjacent pair of dissipation elements of substantially similar length, a spacing between the respective first regions is larger than a spacing between the respective second regions.

25. A lighting device as recited in claim 1, wherein for each adjacent pair of dissipation elements, a spacing between the respective heat dissipation elements is smaller at farther distances from the outer region.

26. A lighting device as recited in claim 1, wherein the lighting device further comprises a housing that defines a light mixing chamber.

27. A lighting device as recited in claim 26, wherein an entirety of each of the heat dissipation elements is spaced from the housing.

28. A lighting device as recited in claim 26, wherein:

the substrate region has a first side and a second side, the first light emitter is mounted on the second side of the substrate region, and the light mixing chamber extends from the second side of the substrate region.

29. A lighting device comprising:

at least a first heat transfer element comprising a substrate region, an outer region, and at least a first thermal connector region. the first thermal connector region extending from the substrate region to the outer region across a portion of a space, the space extending in a plane perpendicular to an axis of the heat transfer element from the substrate region to the outer region;

at least a first light emitter thermally coupled to the substrate region;

a plurality of heat dissipation elements, at least one of the heat dissipation elements having at least a first end and a second end, the second end opposite to the first end, the first end in contact with the first heat transfer element, the second end not in contact with the first heat transfer element and closer to the first light emitter than the first end is.

30. A lighting device as recited in claim 29, wherein:

the first thermal connector region comprises a heat pipe.

31. A lighting device as recited in claim 29, wherein ambient air can pass through a portion of a region between the substrate region and the outer region in a direction that is parallel to an axis of the first heat transfer element.

32. A lighting device comprising:

a plurality of light emitters;

at least a first heat transfer element, an inner space defined by and completely surrounded by an outer region of the first heat transfer element, a first plane and a second plane;

a housing; and a plurality of heat dissipation elements, each heat dissipation element having at least a first region and a second region, the first region in contact with the first heat transfer element, the second region closer to an axis of the first heat transfer element than the first region is, each of the plurality of light emitters in the inner space, at least a first portion of the housing substantially frustoconical, at least part of the first portion of the housing in the inner space, each of the plurality of light emitters thermally coupled to the first heat transfer element, each of the light emitters closer to the axis of the first heat transfer element than any portion of any of the plurality of heat dissipation elements is, the second regions of at least some of the heat dissipation elements slanted relative to the axis of the heat transfer element.

33. A lighting device comprising:

at least a first light emitter;

at least a first heat transfer element having an axis and an annular outer region, an inner space defined by and completely surrounded by the outer region, a first plane and a second plane, the first light emitter in the inner space; and a plurality of heat dissipation elements comprising at least a first heat dissipation element and a second heat dissipation element, each heat dissipation element having at least a first region and a second region, the first region in contact with the first heat transfer element, the second region closer to the first light emitter than the first region is, the first heat dissipation element having a first dissipation element first region and a first dissipation element second region, the first dissipation element first region in contact with the first heat transfer element, the first dissipation element second region closer to the first light emitter than the first dissipation element first region is, the second heat dissipation element having a second dissipation element first region and a second dissipation element second region, the second dissipation element first region in contact with the first heat transfer element, the second dissipation element second region closer to the first light emitter than the second dissipation element first region is, the second dissipation element second region closer to the first light emitter than the first dissipation second region is, at least one of the plurality of heat dissipation elements extending from the outer region into the inner space, the first heat dissipation element having an upper surface and a lower surface relative to a plane perpendicular to an axis of the first heat transfer element, the upper surface and the lower surface exposed in their entireties, the first light emitter thermally coupled to the first heat transfer element.

34. A lighting device comprising:

at least a first light emitter;

at least a first heat transfer element comprising at least a first thermal connector region and an annular outer region, an inner space defined by and completely surrounded by the outer region, a first plane and a second plane, the first light emitter in the inner space; and a plurality of heat dissipation elements comprising at least a first heat dissipation element and a second heat dissipation element, each heat dissipation element having at least a first region and a second region, the first region in contact with the first heat transfer element, the second region closer to the first light emitter than the first region is, the first heat dissipation element having a first dissipation element first region and a first dissipation element second region, the first dissipation element first region in contact with the first heat transfer element, the first dissipation element second region closer to the first light emitter than the first dissipation element first region is, the second heat dissipation element having a second dissipation element first region and a second dissipation element second region, the second dissipation element first region in contact with the first heat transfer element, the second dissipation element second region closer to the first light emitter than the second dissipation element first region is, the second dissipation element second region closer to the first light emitter than the first dissipation second region is, at least one of the plurality of heat dissipation elements extending from the outer region into the inner space, the first light emitter thermally coupled to the first heat transfer element, at least a portion of the first thermal connector region between the first heat dissipation element and the second heat dissipation element.

35. A lighting device as recited in claim 32, wherein for each of at least some of the second regions of the heat dissipation elements, the second regions define an angle slanted relative to the axis of the heat transfer element that is substantially equal to an angle defined by the first portion of the housing.

36. A lighting device as recited in claim 1, wherein the heat transfer element further comprises a substrate region at least partly in the inner space, the first heat dissipation element entirely to one side of a plane extending perpendicular to an axis of the heat transfer element one width of the substrate region from a surface of the substrate region.

* * * * *